US009834731B2

(12) United States Patent
Weiss et al.

(10) Patent No.: US 9,834,731 B2
(45) **Date of Patent: *Dec. 5, 2017**

(54) PROCESS FOR CONVERTING PETROLEUM FEEDSTOCKS COMPRISING A STAGE OF FIXED-BED HYDROTREATMENT, A STAGE OF EBULLATING-BED HYDROCRACKING, A STAGE OF MATURATION AND A STAGE OF SEPARATION OF THE SEDIMENTS FOR THE PRODUCTION OF FUEL OILS WITH A LOW SEDIMENT CONTENT

(71) Applicant: IFP Energies nouvelles, Rueil-Malmaison (FR)

(72) Inventors: Wilfried Weiss, Valencin (FR); Thibaut Corre, Soucieu en Jarrest (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 18 days.

This patent is subject to a terminal disclaimer.

(21) Appl. No.: 14/930,766

(22) Filed: Nov. 3, 2015

(65) Prior Publication Data

US 2016/0122665 A1 May 5, 2016

(30) Foreign Application Priority Data

Nov. 4, 2014 (FR) ..... 14 60627

(51) Int. Cl.
*C10G 67/02* (2006.01)
*C10G 31/06* (2006.01)
(Continued)

(52) U.S. Cl.
CPC ..... *C10G 67/02* (2013.01); *C10G 31/06* (2013.01); *C10G 49/002* (2013.01); *C10G 65/12* (2013.01);
(Continued)

(58) Field of Classification Search
CPC ..... C10G 67/02; C10G 31/06; C10G 49/002; C10G 65/12; C10G 2300/107;
(Continued)

(56) References Cited

U.S. PATENT DOCUMENTS 2,988,501 A 6/1961 Inwood
4,732,664 A * 3/1988 Solari Martini ..... C10G 21/003 208/112
(Continued)

FOREIGN PATENT DOCUMENTS

WO 2014/096704 A1 6/2014

OTHER PUBLICATIONS

Search Report dated Jul. 13, 2015 issued in corresponding FR 1460627 application (pp. 1-2).

*Primary Examiner* — Prem C Singh
*Assistant Examiner* — Brandi M Doyle
(74) *Attorney, Agent, or Firm* — Millen, White, Zelano, Branigan, P.C.

(57) ABSTRACT

A process for converting heavy petroleum feedstocks to produce fuel oils and fuel-oil bases with a low sediment content comprises: a) fixed-bed hydrotreatment, b) optional separation of the effluent originating from the hydrotreatment stage a), c) hydrocracking of at least a part of the effluent from a) or of at least a part of the heavy fraction originating from b), d) separation of the effluent originating from c), e) maturation of the heavy liquid fraction originating from the separation d), and f) separation of the sediments from the heavy liquid fraction originating from the maturation e).

23 Claims, 3 Drawing Sheets

(51) Int. Cl.
*C10G 49/00* (2006.01)
*C10G 65/12* (2006.01)

(52) U.S. Cl.
CPC ..... *C10G 2300/107* (2013.01); *C10G 2300/1077* (2013.01); *C10G 2300/202* (2013.01); *C10G 2300/206* (2013.01); *C10G 2300/208* (2013.01)

(58) Field of Classification Search
CPC ..... C10G 2300/1077; C10G 2300/202; C10G 2300/206; C10G 2300/208
See application file for complete search history.

(56) References Cited

U.S. PATENT DOCUMENTS

| | | | | |
|---|---|---|---|---|
| 5,417,846 | A * | 5/1995 | Renard | C10G 67/06 208/210 |
| 6,447,671 | B1 * | 9/2002 | Morel | C10G 65/04 208/210 |
| 2013/0026074 | A1 | 1/2013 | Koseoglu et al. | |

* cited by examiner

PROCESS FOR CONVERTING PETROLEUM FEEDSTOCKS COMPRISING A STAGE OF FIXED-BED HYDROTREATMENT, A STAGE OF EBULLATING-BED HYDROCRACKING, A STAGE OF MATURATION AND A STAGE OF SEPARATION OF THE SEDIMENTS FOR THE PRODUCTION OF FUEL OILS WITH A LOW SEDIMENT CONTENT

The present invention relates to the refining and conversion of heavy hydrocarbon fractions containing, among other things, sulphur-containing impurities. It relates more particularly to a process for converting heavy petroleum feedstocks of the atmospheric residue and/or vacuum residue type for the production of heavy fractions that can be used as fuel-oil bases, in particular bunker oil bases, with a low sediment content. The process according to the invention also makes it possible to produce atmospheric distillates (naphtha, kerosene and diesel), vacuum distillates and light gases (C1 to C4).

The quality requirements for marine fuels are described in standard ISO 8217. From now on the specification concerning sulphur will relate to $SO_x$ emissions (Annex VI of the MARPOL convention of the International Maritime Organization) and is expressed as a recommendation for the sulphur content to be less than or equal to 0.5% by weight outside the Sulphur Emissions Control Areas (SECAs) for the 2020-2025 time frame, and less than or equal to 0.1% by weight in the SECAs. Another very restrictive recommendation is the sediment content after ageing according to ISO 10307-2 (also known as IP390), which must be less than or equal to 0.1%.

The sediment content according to ISO 10307-1 (also known as IP375) is different from the sediment content after ageing according to ISO 10307-2 (also known as IP390). The sediment content after ageing according to ISO 10307-2 is a much more restrictive specification and corresponds to the specification that applies to bunker oils.

According to Annex VI of the MARPOL convention, a vessel will therefore be able to use a sulphur-containing fuel oil if the vessel is equipped with a system for treating fumes that makes it possible to reduce emissions of sulphur oxides.

Processes for the refining and conversion of heavy petroleum feedstocks comprising a first stage of fixed-bed hydrotreatment and then a stage of ebullating-bed hydrocracking have been described in patent documents FR 2764300 and EP 0665282. EP 0665282 describes a process for the hydrotreatment of heavy oils, the objective of which is to prolong the service life of the reactors. The process described in FR 2764300 describes a process with the objective of obtaining fuels (gasoline and diesel) in particular having a low sulphur content. The feedstocks treated in this process do not contain asphaltenes.

The fuel oils used in maritime transport generally comprise atmospheric distillates, vacuum distillates, atmospheric residues and vacuum residues originating from direct distillation or originating from a refining process, in particular from hydrotreatment and conversion processes, these cuts being able to be used alone or in a mixture. Although these processes are known to be suitable for heavy feedstocks laden with impurities, they nevertheless produce hydrocarbon-containing fractions comprising catalyst fines and sediments, which must be removed to satisfy a product quality such as bunker oil.

The sediments can be precipitated asphaltenes. Initially, the conversion conditions and in particular the temperature in the feedstock cause them to undergo reactions (dealkylation, polymerization, etc.) leading to their precipitation. Independently of the nature of the feedstock, these phenomena generally occur when severe conditions bringing about high conversion rates (for compounds boiling at more than 540° C.: 540+° C.), i.e. greater than 30, 40 or 50%, are used.

In his research, the applicant has developed a new process incorporating a stage of maturation and separation of the sediments downstream of a fixed-bed hydrotreatment stage and a hydrocracking stage. It was surprisingly found that such a process made it possible to obtain liquid hydrocarbon-containing fractions having a low sediment content after ageing, said fractions advantageously being able to be used completely or partially as a fuel oil or as a fuel-oil base complying with future specifications, namely having a sediment content after ageing of less than or equal to 0.1% by weight.

One of the objectives of the present invention is to propose a process for converting heavy petroleum feedstocks for the production of fuel oils and fuel-oil bases, in particular bunker oils and bunker oil bases, with a low sediment content after ageing of less than or equal to 0.1% by weight.

Another objective of the present invention is to produce jointly, by means of the same process, atmospheric distillates (naphtha, kerosene, diesel), vacuum distillates and/or light gases (C1 to C4). The bases of the naphtha and diesel type can be upscaled in the refinery for the production of automobile and aviation fuels, for example premium-grade gasolines, jet fuels and gas oils.

DETAILED DESCRIPTION

The Feedstock

Figure 1:
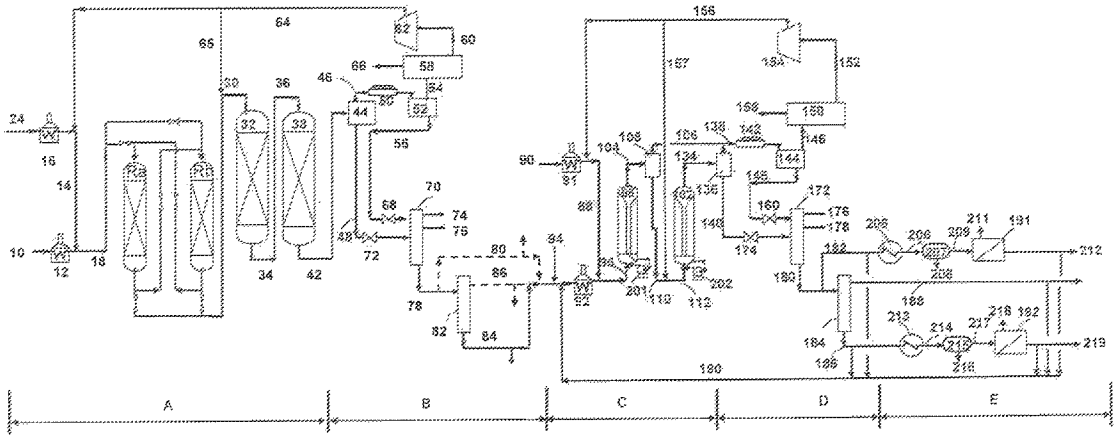
FIG. 1 shows a diagrammatic view of the process according to the invention, showing a hydrotreatment zone, a zone for the separation of the effluent from the hydrotreatment zone, a hydrocracking zone and a zone for the separation of the effluent from the hydrocracking zone and a zone for maturation and separation of the sediments.

The feedstock treated in the process according to the invention is advantageously a hydrocarbon-containing feedstock having an initial boiling temperature of at least 340° C. and a final boiling temperature of at least 440° C. Preferably, its initial boiling temperature is at least 350° C., preferably at least 375° C., and its final boiling temperature is at least 450° C., preferably at least 460° C., more preferably at least 540° C., and even more preferably at least 600° C.

The hydrocarbon-containing feedstock according to the invention can be selected from atmospheric residues, vacuum residues originating from direct distillation, crude oils, topped crude oils, deasphalting resins, asphalts or deasphalting pitches, residues originating from conversion processes, aromatic extracts originating from lubricant base production chains, bituminous sands or derivatives thereof, oil shales or derivatives thereof, source rock oils or derivatives thereof, alone or in a mixture. The feedstocks that are treated in the present invention are preferably atmospheric residues or vacuum residues, or mixtures of these residues.

The hydrocarbon-containing feedstock treated in the process can contain, among other things, sulphur-containing impurities. The sulphur content can be at least 0.1% by weight, at least 0.5% by weight, preferably at least 1% by weight, more preferably at least 4% by weight, even more preferably at least 5% by weight. Advantageously, the feedstock can contain at least 1% C7 asphaltenes and at least 5 ppm of metals, preferably at least 2% C7 asphaltenes and at least 25 ppm of metals.

These feedstocks can advantageously be used as they are. Alternatively, they can be diluted with a co-feedstock. This co-feedstock can be a hydrocarbon-containing fraction or a mixture of lighter hydrocarbon-containing fractions, which can preferably be selected from the products originating from a fluid catalytic cracking (FCC) process, a light cycle oil (LCO), a heavy cycle oil (HCO), a decanted oil, an FCC residue, a gas oil fraction, in particular a fraction obtained by atmospheric or vacuum distillation, for example vacuum gas oil, or can also originate from another refining process. The co-feedstock can also advantageously be one or more cuts originating from the process for liquefaction of coal or biomass, aromatic extracts, or any other hydrocarbon-containing cuts or also non-petroleum feedstocks such as pyrolysis oil. The heavy hydrocarbon-containing feedstock according to the invention can represent at least 50%, preferably 70%, more preferably at least 80%, and even more preferably at least 90% by weight of the total hydrocarbon-containing feedstock treated by the process according to the invention.

The process according to the invention therefore comprises a first stage a) of fixed-bed hydrotreatment, optionally a stage b) of separation of the effluent originating from the hydrotreatment stage a) into a light fraction and a heavy fraction, followed by a stage c) of ebullating-bed hydrocracking of at least a part of the effluent originating from stage a) or of at least a part of the heavy fraction originating from stage b), a stage d) of separation of the effluent originating from stage c) in order to obtain at least one gaseous fraction and at least one heavy liquid fraction and finally a maturation stage e) and a separation stage f) utilized for the heavy liquid fraction making it possible to obtain a liquid hydrocarbon-containing fraction having a sediment content after ageing of less than or equal to 0.1% by weight.

The objective of hydrotreatment is both to refine, i.e. greatly reduce the content of metals, sulphur and other impurities, while improving the hydrogen-to-carbon ratio (H/C) and while converting the hydrocarbon-containing feedstock more or less partially into lighter cuts. The effluent obtained in the stage a) of fixed-bed hydrotreatment can then be sent to the stage c) of ebullating-bed hydrocracking either directly, or after being subjected to a stage of separation of the light fractions. Stage c) allows a partial conversion of the feedstock so as to produce an effluent comprising in particular catalyst fines and sediments, which must be removed in order to satisfy a product quality such as bunker oil. The process according to the invention is characterized in that it comprises a maturation stage e) and a separation stage f) carried out under conditions making it possible to improve the effectiveness of separation of the sediments and thus to obtain fuel oils or fuel-oil bases having a sediment content after ageing of less than or equal to 0.1% by weight.

One of the benefits of the sequence of fixed-bed hydrotreatment, and then ebullating-bed hydrocracking, is that the feedstock of the ebullating-bed hydrocracking reactor is already at least partially hydrotreated. It is thus possible to obtain, at equivalent conversion, hydrocarbon-containing effluents of better quality, in particular with lower sulphur contents. Moreover, the catalyst consumption in the ebullating-bed hydrocracking reactor is greatly reduced relative to a process without preliminary fixed-bed hydrotreatment.

Stage a) of Hydrotreatment

The feedstock according to the invention is subjected according to the process of the present invention to a stage a) of fixed-bed hydrotreatment in which the feedstock and hydrogen are brought into contact on a hydrotreatment catalyst.

By hydrotreatment, commonly called HDT, is meant the catalytic treatments with supply of hydrogen making it possible to refine, i.e. greatly reduce, the content of metals, sulphur and other impurities, of the hydrocarbon-containing feedstocks, while improving the hydrogen-to-carbon ratio in the feedstock and converting the feedstock more or less partially into lighter cuts. Hydrotreatment in particular comprises hydrodesulphurization reactions (commonly called HDS), hydrodenitrogenation reactions (commonly called HDN) and hydrodemetallization reactions (commonly called HDM), accompanied by hydrogenation, hydrodeoxygenation, hydrodearomatization, hydroisomerization, hydrodealkylation, hydrocracking, hydrodeasphalting and Conradson carbon reduction reactions.

According to a preferred variant, the hydrotreatment stage a) comprises a first stage a1) of hydrodemetallization (HDM) carried out in one or more fixed-bed hydrodemetallization zones and a second subsequent stage a2) of hydrodesulphurization (HDS) carried out in one or more fixed-bed hydrodesulphurization zones. In the course of said first stage a1) of hydrodemetallization, the feedstock and hydrogen are brought into contact on a hydrodemetallization catalyst, under conditions of hydrodemetallization, then during said second stage a2) of hydrodesulphurization, the effluent from the first stage a1) of hydrodemetallization is brought into contact with a hydrodesulphurization catalyst, under conditions of hydrodesulphurization. This process, known as HYVAHL-FTM, is described for example in U.S. Pat. No. 5,417,846.

A person skilled in the art will readily understand that, in the stage of hydrodemetallization, reactions of hydrodemetallization are carried out, but in parallel also a part of the other reactions of hydrotreatment and in particular of hydrodesulphurization. Moreover, in the hydrodesulphurization stage, hydrodesulphurization reactions are carried out, but in parallel also a part of the other reactions of hydrotreatment and in particular of hydrodemetallization. A person skilled in the art will understand that the hydrodemetallization stage begins where the hydrotreatment stage begins, or where the concentration of metals is at a maximum. A person skilled in the art will understand that the hydrodesulphurization stage ends where the hydrotreatment stage ends, or where removal of sulphur is the most difficult. Between the hydrodemetallization stage and the hydrodesulphurization stage, a person skilled in the art sometimes defines a transition zone in which all the types of hydrotreatment reaction take place.

The stage a) of hydrotreatment according to the invention is carried out under hydrotreatment conditions. It can advantageously be carried out at a temperature comprised between 300° C. and 500° C., preferably between 350° C. and 420° C. and at a hydrogen partial pressure comprised between 5 MPa and 35 MPa, preferably between 11 MPa and 20 MPa. The temperature is habitually adjusted as a function of the desired level of hydrotreatment and the required treatment time. Usually, the space velocity of the hydrocarbon-containing feedstock, commonly called HSV, which is defined as being the volume flow rate of the feedstock divided by the total volume of the reactor, can be comprised within a range from 0.1 $h^{-1}$ to 5 $h^{-1}$, preferably from 0.1 $h^{-1}$ to 2 $h^{-1}$, and more preferably from 0.1 $h^{-1}$ to 0.45 $h^{-1}$. The quantity of hydrogen mixed with the feedstock can be comprised between 100 and 5000 normal cubic meters ($Nm^3$) per cubic meter ($m^3$) of liquid feedstock, preferably between 200 $Nm^3/m^3$ and 2000 $Nm^3/m^3$, and more preferably between 300 $Nm^3/m^3$ and 1500 $Nm^3/m^3$. The stage a) of hydrotreatment can be carried out industrially in one or more reactors with descending flow of liquid.

The hydrotreatment catalysts used are preferably known catalysts. They can be granular catalysts comprising, on a support, at least one metal or metal compound having a hydrodehydrogenating function. These catalysts can advantageously be catalysts comprising at least one metal of group VIII, generally selected from the group constituted by nickel and cobalt, and/or at least one metal of group VIB, preferably molybdenum and/or tungsten. For example, a catalyst can be used comprising 0.5 to 10% by weight of nickel, preferably 1 to 5% by weight of nickel (expressed as nickel oxide NiO), and 1 to 30% by weight of molybdenum, preferably 5 to 20% by weight of molybdenum (expressed as molybdenum oxide $MoO_3$) on a mineral support. This support can for example be selected from the group constituted by alumina, silica, silica-aluminas, magnesia, clays and mixtures of at least two of these minerals. Advantageously, this support can contain other doping compounds, in particular oxides selected from the group constituted by boron oxide, zirconia, ceria, titanium oxide, phosphoric anhydride and a mixture of these oxides. Usually an alumina support is used, and very often an alumina support doped with phosphorus and optionally with boron. When phosphoric anhydride $P_2O_5$ is present, its concentration is less than 10% by weight. When boron trioxide $B_2O_3$ is present, its concentration is less than 10% by weight. The alumina used can be a γ (gamma) or η (eta) alumina. This catalyst is usually in the form of extrudates. The total content of oxides of metals of groups VIB and VIII can be from 5 to 40% by weight and generally from 7 to 30% by weight and the weight ratio expressed as metallic oxide between a metal (or metals) of group VIB and a metal (or metals) of group VIII is generally comprised between 20 and 1, and usually between 10 and 2.

In the case of a hydrotreatment stage including a hydrodemetallization (HDM) stage and then a hydrodesulphurization (HDS) stage, specific catalysts suitable for each stage are preferably used.

Catalysts that can be used in the hydrodemetallization stage are for example indicated in the patent documents EP 0113297, EP 0113284, U.S. Pat. No. 5,221,656, U.S. Pat. No. 5,827,421, U.S. Pat. No. 7,119,045, U.S. Pat. No. 5,622,616 and U.S. Pat. No. 5,089,463. HDM catalysts are preferably used in switchable reactors.

Catalysts that can be used in the hydrodesulphurization stage are for example indicated in the patent documents EP 0113297, EP 0113284, U.S. Pat. No. 6,589,908, U.S. Pat. No. 4,818,743 or U.S. Pat. No. 6,332,976.

It is also possible to use a mixed catalyst, active in hydrodemetallization and in hydrodesulphurization, both for the hydrodemetallization section and for the hydrodesulphurization section as described in the patent document FR 2940143.

Prior to the injection of the feedstock, the catalysts used in the process according to the present invention are preferably subjected to an in situ or ex situ sulphurization treatment.

Optional Separation Stage b)

The stage of separation of the effluent originating from the hydrotreatment stage a) is optional.

In the case in which the stage of separation of the effluent originating from the hydrotreatment stage a) is not used, at least a part of the effluent originating from the hydrotreatment stage a) is introduced into the section allowing the stage c) of ebullating-bed hydrocracking to be carried out without change of chemical composition and without significant loss of pressure. By "significant loss of pressure" is meant a loss of pressure caused by an expansion valve or turbine, which could be estimated at a loss of pressure of more than 10% of the total pressure.

A person skilled in the art generally uses these losses of pressure or expansions during the separation stages.

When the separation stage is carried out on the effluent originating from the hydrotreatment stage a), the latter is optionally supplemented with other additional separation stages, making it possible to separate at least one light fraction and at least one heavy fraction.

By "light fraction" is meant a fraction in which at least 90% of the compounds have a boiling point of less than 350° C.

By "heavy fraction" is meant a fraction in which at least 90% of the compounds have a boiling point greater than or equal to 350° C. Preferably, the light fraction obtained in the separation stage b) comprises a gas phase and at least one light hydrocarbon fraction of the naphtha, kerosene and/or diesel type. The heavy fraction preferably comprises a vacuum distillate fraction and a vacuum residue fraction and/or an atmospheric residue fraction.

The separation stage b) can be carried out by any method known to a person skilled in the art. This method can be selected from a high- or low-pressure separation, a high- or low-pressure distillation, a high- or low-pressure stripping, and the combinations of these different methods that can be operated at different pressures and temperatures.

According to a first embodiment of the present invention, the effluent from the hydrotreatment stage a) undergoes a separation stage b) with decompression. According to this embodiment, the separation is preferably carried out in a fractionation section, which can firstly comprise a high-pressure high-temperature (HPHT) separator, and optionally a high-pressure low-temperature (HPLT) separator, then optionally followed by an atmospheric distillation section and/or a vacuum distillation section. The effluent from stage a) can be sent to a fractionation section, generally to an HPHT separator making it possible to obtain a light fraction and a heavy fraction containing a majority of compounds boiling at at least 350° C. Generally, separation is preferably not carried out according to a precise cut point; rather it resembles a separation of the flash type. The cut point for separation is advantageously between 200 and 400° C.

Preferably, said heavy fraction can then be fractionated by atmospheric distillation into at least one atmospheric distillate fraction, preferably containing at least one light hydrocarbon fraction of the naphtha, kerosene and/or diesel type, and an atmospheric residue fraction. At least a part of the atmospheric residue fraction can also be fractionated by vacuum distillation into a vacuum distillate fraction, preferably containing vacuum gas oil, and a vacuum residue fraction. At least a part of the vacuum residue fraction and/or of the atmospheric residue fraction is advantageously sent to the hydrocracking stage c). A part of the vacuum residue can also be recycled to the hydrotreatment stage a).

According to a second embodiment, the effluent originating from the hydrotreatment stage a) undergoes a separation stage b) without decompression. According to this embodiment, the effluent from the hydrotreatment stage a) is sent to a fractionation section, generally into an HPHT separator, having a cut point between 200 and 400° C. making it possible to obtain at least one light fraction and at least one heavy fraction. Generally, the separation is preferably not carried out according to a precise cut point, rather it resembles a separation of the flash type. The heavy fraction can then be directly sent to the hydrocracking stage c).

The light fraction can undergo other separation stages. Advantageously, it can be subjected to atmospheric distillation in order to obtain a gaseous fraction, at least one light hydrocarbon liquid fraction of the naphtha, kerosene and/or diesel type and a vacuum distillate fraction, the latter being able to be sent at least in part to the hydrocracking stage c). Another part of the vacuum distillate can be used as a fuel oil fluxing agent. Another part of the vacuum distillate can be upscaled by being subjected to a stage of hydrocracking and/or of catalytic cracking in a fluidized bed.

Separation without decompression allows better thermal integration and is reflected in a saving of energy and equipment. Moreover, this embodiment offers technical and economic advantages, given that it is not necessary to increase the pressure of the flows after separation before the subsequent hydrocracking stage. As intermediate fractionation without decompression is simpler than fractionation with decompression, the capital expenditure is therefore advantageously reduced.

The gaseous fractions originating from the separation stage preferably undergo a purification treatment in order to recover the hydrogen and recycle it to the hydrotreatment and/or hydrocracking reactors. The presence of the separation stage between the hydrotreatment stage a) and the hydrocracking stage c) advantageously makes it possible to have two independent hydrogen circuits available, one linked to the hydrotreatment, the other to the hydrocracking, and which can be linked to one another, as required. The make-up hydrogen can be added in the hydrotreatment section or in the hydrocracking section or in both. The recycling hydrogen can feed the hydrotreatment section or the hydrocracking section or both. A compressor can optionally be common to both hydrogen circuits. Being able to link the two hydrogen circuits together makes it possible to optimize management of hydrogen and to limit investments in terms of compressors and/or purification units of the gaseous effluents. The different embodiments of hydrogen management that can be used in the present invention are described in the patent application FR 2957607.

The light fraction obtained at the end of the separation stage b), which comprises hydrocarbons of the naphtha, kerosene and/or diesel type or others, in particular LPG and vacuum gas oil, can be upscaled according to the methods well known to a person skilled in the art. The products obtained can be incorporated in fuel formulations (also called fuel "pools") or can undergo additional refining stages. The naphtha, kerosene, and gas oil fraction(s) and the vacuum gas oil can be subjected to one or more treatments, for example hydrotreatment, hydrocracking, alkylation, isomerization, catalytic reforming, catalytic or thermal cracking, in order to bring them, separately or in a mixture, up to the required specifications, which can relate to the sulphur content, smoke point, octane number, cetane number, etc.

Stage c) of Ebullating-Bed Hydrocracking

At least a part of the effluent originating from the hydrotreatment stage a) or at least a part of the heavy fraction originating from stage b) is sent, according to the process of the present invention, to a hydrocracking stage c), which is carried out in at least one reactor, advantageously two reactors, containing at least one supported catalyst in an ebullating bed. Said reactor can operate with liquid and gas upflow. The main objective of hydrocracking is to convert the heavy hydrocarbon-containing feedstock into lighter cuts while partially refining it.

According to an embodiment of the present invention, a part of the initial hydrocarbon-containing feedstock can be injected directly at the inlet of the ebullating-bed hydrocracking section c), in a mixture with the effluent from the fixed-bed hydrotreatment section a) or the heavy fraction originating from stage b), without treating this part of the hydrocarbon-containing feedstock in the fixed-bed hydrotreatment section a). This embodiment can resemble a partial short-circuit of the fixed-bed hydrotreatment section a).

According to a variant, a co-feedstock can be introduced at the inlet of the ebullating-bed hydrocracking section c) with the effluent from the fixed-bed hydrotreatment section a) or the heavy fraction originating from stage b). This co-feedstock can be selected from atmospheric residues, vacuum residues originating from direct distillation, deasphalted oils, aromatic extracts originating from lubricant base production chains, hydrocarbon-containing fractions or a mixture of hydrocarbon-containing fractions that can be selected from the products originating from a fluid catalytic cracking process, in particular a light cycle oil (LCO), a heavy cycle oil (HCO), a decanted oil, or that can come from distillation, gas oil fractions, in particular those obtained by atmospheric or vacuum distillation, such as for example vacuum gas oil. According to another variant and in the case in which the hydrocracking section has several ebullating-bed reactors, this co-feedstock can be injected partially or totally into one of the reactors downstream of the first reactor.

The hydrogen required for the hydrocracking reaction can already be present in a sufficient quantity in the effluent originating from the hydrotreatment stage a) injected at the inlet of the ebullating-bed hydrocracking section c). It is preferable, however, to provide an additional supply of hydrogen at the inlet of the hydrocracking section c). In the case in which the hydrocracking section has several ebullating-bed reactors available, hydrogen can be injected at the inlet of each reactor. The hydrogen injected can be a make-up stream and/or a recycling stream.

The ebullating-bed technology is well known to a person skilled in the art. Only the main operating conditions will be described here. Ebullating-bed technologies conventionally use supported catalysts in the form of extrudates, the diameter of which is generally of the order of 1 millimeter or less. The catalysts remain within the reactors and are not evacuated with the products, except during the phases of catalyst make-up and drawing off necessary for maintaining catalytic activity. The temperature levels can be high in order to obtain high conversions while minimizing the quantities of catalysts used. The catalytic activity can be kept constant due to in-line replacement of the catalyst. It is therefore not necessary to stop the unit in order to replace the spent catalyst, nor to increase the reaction temperatures throughout the cycle in order to compensate for deactivation. In addition, working under constant operating conditions advantageously makes it possible to obtain constant yields and product qualities throughout the cycle. Thus, because the catalyst is kept under agitation by significant liquid recycling, the pressure drop in the reactor remains low and constant. Owing to wear of the catalysts in the reactors, the products leaving the reactors can contain fine particles of catalyst.

The conditions of the stage c) of ebullating-bed hydrocracking can be conventional conditions of hydrocracking a hydrocarbon-containing feedstock in an ebullating bed. It is possible to operate at an absolute pressure comprised between 2.5 MPa and 35 MPa, preferably between 5 MPa and 25 MPa, more preferably between 6 MPa and 20 MPa, and even more preferably between 11 MPa and 20 MPa at a temperature comprised between 330° C. and 550° C., preferably between 350° C. and 500° C. The space velocity (HSV) and the hydrogen partial pressure are parameters that are fixed as a function of the characteristics of the product to be treated and the desired conversion. The HSV is habitually in a range from 0.1 $h^{-1}$ to 10 $h^{-1}$, preferably 0.2 $h^{-1}$ to 5 $h^{-1}$ and more preferably 0.2 $h^{-1}$ to 1 $h^{-1}$. The quantity of hydrogen mixed with the feedstock is usually 50 to 5000 normal cubic meters ($Nm^3$) per cubic meter ($m^3$) of liquid feedstock, most often 100 $Nm^3/m^3$ to 1500 $Nm^3/m^3$ and preferably 200 $Nm^3/m^3$ to 1200 $Nm^3/m^3$.

A conventional granular hydrocracking catalyst can be used, comprising, on an amorphous support, at least one metal or metal compound having a hydrodehydrogenating function. This catalyst can be a catalyst comprising metals of group VIII, for example nickel and/or cobalt, most often combined with at least one metal of group VIB, for example molybdenum and/or tungsten. For example a catalyst comprising 0.5 to 10% by weight of nickel and preferably 1 to 5% by weight of nickel (expressed as nickel oxide NiO) and 1 to 30% by weight of molybdenum, preferably 5 to 20% by weight of molybdenum (expressed as molybdenum oxide $MoO_3$) on an amorphous mineral support can be used. This support can, for example, be selected from the group formed by alumina, silica, silica-aluminas, magnesia, clays and mixtures of at least two of these minerals. This support can also include other compounds and, for example, oxides selected from the group formed by boron oxide, zirconia, titanium oxide, phosphoric anhydride. An alumina support is most often used, and a support of alumina doped with phosphorus and optionally boron is very often used. When phosphoric anhydride $P_2O_5$ is present, the concentration thereof is normally less than 20% by weight and most often less than 10% by weight. When boron trioxide $B_2O_3$ is present, the concentration thereof is normally less than 10% by weight. The alumina used is normally a γ (gamma) or η (eta) alumina. This catalyst can be in the form of extrudates. The total content of oxides of metals of groups VI and VIII can be comprised between 5 and 40% by weight, preferably between 7 and 30% by weight, and the weight ratio expressed as metallic oxide between a metal (or metals) of group VI and a metal (or metals) of group VIII is comprised between 20 and 1, preferably between 10 and 2.

The spent catalyst can partially be replaced with fresh catalyst, generally by drawing-off from the base of the reactor and introduction of fresh or new catalyst at the top of the reactor at regular time intervals, i.e., for example, in batches or continuously or almost continuously. The catalyst can also be introduced through the base and drawn off from the top of the reactor. For example, fresh catalyst can be introduced every day. The rate of replacement of the spent catalyst with fresh catalyst can be, for example, from approximately 0.05 kilogram to approximately 10 kilograms per cubic meter of feedstock. This drawing-off and replacement are carried out using devices allowing continuous operation of this hydrocracking stage. The hydrocracking reactor normally comprises a recirculating pump allowing the catalyst to be kept in the ebullating bed by continuous recycling of at least a part of the liquid drawn off at the head of the reactor and reinjected at the base of the reactor. It is also possible to send the spent catalyst drawn off from the reactor into a regeneration zone in which the carbon and sulphur which it contains are removed before it is reinjected into the hydrocracking stage (b).

The hydrocracking stage c) according to the process of the invention can be carried out under the conditions of the H-OIL® process, as described for example in U.S. Pat. No. 6,270,654.

Ebullating-bed hydrocracking can be carried out in a single reactor or in several reactors, preferably two, arranged in series. By using at least two ebullating-bed reactors in series, it is possible to obtain products of better quality and with a better yield. Moreover, hydrocracking in two reactors makes it possible to have improved operability with respect to the flexibility of the operating conditions and of the catalytic system. The temperature of the second ebullating-bed reactor is preferably at least 5° C. higher than that of the first ebullating-bed reactor. The pressure of the second reactor can be from 0.1 MPa to 1 MPa lower than for the first reactor in order to allow the flow of at least a part of the effluent originating from the first stage without requiring pumping. The different operating conditions in terms of temperature in the two hydrocracking reactors are selected so as to be able to control hydrogenation and conversion of the feedstock into desired products in each reactor.

In the case in which the hydrocracking stage c) is carried out in two substages c1) and c2) in two reactors arranged in series, the effluent obtained at the end of the first substage c1) can optionally be subjected to a stage of separation of the light fraction and heavy fraction, and at least a part, preferably all, of said heavy fraction can be treated in the second hydrocracking substage c2). This separation is advantageously performed in an interstage separator, as described for example in the U.S. Pat. No. 6,270,654, and can in particular avoid overcracking of the light fraction in the second hydrocracking reactor. It is also possible to transfer, wholly or partially, the spent catalyst drawn off from the reactor of the first hydrocracking substage (b1), operating at lower temperature, directly to the reactor of the second substage (b2), operating at a higher temperature, or transfer, wholly or partially, the spent catalyst drawn off from the reactor of the second substage (b2) directly to the reactor of the first substage (b1). This cascade system is described for example in the U.S. Pat. No. 4,816,841.

The hydrocracking stage can also be carried out with several reactors in parallel (generally two) in the case of large capacity. The hydrocracking stage can thus comprise several stages in series, optionally separated by an interstage separator, each stage being constituted by one or more reactors in parallel.

Stage d) of Separation of the Hydrocracking Effluent

The process according to the invention can further comprise a separation stage d) for obtaining at least one gaseous fraction and at least one heavy liquid fraction.

The effluent obtained at the end of the hydrocracking stage c) comprises a liquid fraction and a gaseous fraction containing gases, in particular $H_2$, $H_2S$, $NH_3$, and C1-C4 hydrocarbons. This gaseous fraction can be separated from the effluent using separation devices well known to a person skilled in the art, in particular using one or more separating drums that can operate at different pressures and temperatures, optionally combined with a means for steam or hydrogen stripping and with one or more distillation columns. The effluent obtained at the end of the hydrocracking stage c) is advantageously separated in at least one separating drum into at least one gaseous fraction and at least one heavy liquid fraction. These separators can for example be high-pressure high-temperature (HPHT) separators and/or high-pressure low-temperature (HPLT) separators.

After optional cooling, this gaseous fraction is preferably treated in a means for hydrogen purification so as to recover the hydrogen that was not consumed in the reactions of hydrotreatment and hydrocracking. The means for hydrogen purification can be washing with amines, a membrane, a system of the PSA type, or several of these means arranged in series. The purified hydrogen can then advantageously be recycled into the process according to the invention, after an optional recompression. The hydrogen can be introduced at the inlet of the hydrotreatment stage a) and/or at different points in the course of the hydrotreatment stage a) and/or at the inlet of the hydrocracking stage c) and/or at different points in the hydrocracking stage c).

The separation stage d) can also comprise atmospheric distillation and/or vacuum distillation. Advantageously, the separation stage d) further comprises at least one atmospheric distillation, in which the liquid hydrocarbon-containing fraction or fractions obtained after separation is (or are) fractionated by atmospheric distillation into at least one atmospheric distillate fraction and at least one atmospheric residue fraction. The atmospheric distillate fraction can contain fuel bases (naphtha, kerosene and/or diesel) that can be upscaled commercially, for example in the refinery for the production of automobile and aviation fuels.

Moreover, the separation stage d) of the process according to the invention can advantageously further comprise at least one vacuum distillation in which the liquid hydrocarbon-containing fraction or fractions obtained after separation and/or the atmospheric residue fraction obtained after atmospheric distillation is (or are) fractionated by vacuum distillation into at least one vacuum distillate fraction and at least one vacuum residue fraction. Preferably, the separation stage d) comprises firstly atmospheric distillation, in which the liquid hydrocarbon-containing fraction or fractions obtained after separation is (or are) fractionated by atmospheric distillation into at least one atmospheric distillate fraction and at least one atmospheric residue fraction, and then vacuum distillation in which the atmospheric residue fraction obtained after atmospheric distillation is fractionated by vacuum distillation into at least one vacuum distillate fraction and at least one vacuum residue fraction. The vacuum distillate fraction typically contains fractions of the vacuum gas oil type.

At least a part of the vacuum residue fraction can be recycled to the hydrocracking stage c).

Stage e): Maturation of the Sediments

The heavy liquid fraction obtained at the end of the separation stage d) contains organic sediments which result from the hydrotreatment and hydrocracking conditions and from the catalyst residues. A part of the sediments is constituted by asphaltenes precipitated under the hydrotreatment and hydrocracking conditions and are analyzed as existing sediments (IP375).

Depending on the hydrocracking conditions, the sediment content in the heavy liquid fraction varies. From an analytical point of view, a distinction is made between the existing sediments (IP375) and the sediments after ageing (IP390) which include the potential sediments. More severe hydrocracking conditions, i.e. when the conversion rate is for example greater than 40 or 50%, cause the formation of existing sediments and of potential sediments.

In order to obtain a fuel oil or a fuel-oil base complying with the recommendations of a sediment content after ageing (IP390) of less than or equal to 0.1%, the process according to the invention comprises a maturation stage making it possible to improve the effectiveness of separation of the sediments and thus to obtain stable fuel oils or fuel-oil bases, i.e. a sediment content after ageing of less than or equal to 0.1% by weight.

The maturation stage according to the invention makes it possible to form all of the existing and potential sediments (by converting the potential sediments into existing sediments) so as to separate them more effectively and thus to respect the sediment content after ageing (IP390) of 0.1% by weight at most.

The maturation stage according to the invention is advantageously implemented for a residence time comprised between 1 and 1500 minutes, preferably between 25 and 300 minutes, more preferably between 60 and 240 minutes, at a temperature between 50 and 350° C., preferably between 75 and 300° C. and more preferably between 100 and 250° C., a pressure of less than 20 MPa, preferably less than 10 MPa, more preferably less than 3 MPa and even more preferably less than 1.5 MPa.

The maturation stage can be carried out using an exchanger or heating furnace followed by one or more enclosures in series or in parallel such as a horizontal or vertical drum, optionally with a decantation function for removing a part of the heaviest solids, and/or a piston reactor. A stirred and heated vessel can also be used, and can be equipped with a drawing-off device at the bottom for removing a part of the heaviest solids.

Advantageously, the stage e) of maturation of the heavy liquid fraction originating from stage d) is carried out in the presence of an inert gas and/or an oxidizing gas.

The maturation stage e) can be carried out in the presence of an inert gas such as nitrogen, or in the presence of an oxidizing gas such as oxygen, or in the presence of a mixture containing an inert gas and an oxidizing gas such as air or nitrogen-depleted air. The use of an oxidizing gas makes it possible to speed up the maturation process.

In the case where the maturation stage is carried out in the presence of an inert and/or oxidizing gas, said gas is mixed with the heavy liquid fraction originating from stage d) before the maturation stage, then this gas is separated after the maturation so as to obtain a liquid fraction at the outlet of the maturation stage e). Such a use of gas/liquid can for example be carried out in a bubble tower. According to another implementation, the inert and/or oxidizing gas can also be introduced during the maturation stage e), for example by means of bubbling (injection of gas through the base) into a stirred tank, which makes it possible to promote the gas/liquid contact.

At the end of the maturation stage e), at least one hydrocarbon-containing fraction is obtained having a content enriched with existing sediments, which is sent into the stage f) of separating the sediments.

Stage f): Separation of the Sediments

The process according to the invention moreover comprises a stage f) of separating the sediments and residues of catalysts in order to obtain a liquid hydrocarbon-containing fraction having a sediment content after ageing of less than or equal to 0.1% by weight.

The heavy liquid fraction obtained at the end of the maturation stage e) contains organic sediments of the precipitated asphaltenes type, which result from the hydrocracking and maturation conditions. This heavy fraction can also contain catalyst fines originating from the wear of catalysts of the extrudates type in the implementation of the hydrocracking reactor.

Thus, at least a part of the heavy liquid fraction originating from the maturation stage e) is subjected to a separation of the sediments and of the residues of catalysts, by means of at least one physical separation means selected from a filter, a separation membrane, a filtering bed of solids of the organic or inorganic type, an electrostatic precipitation, a centrifugation system, decantation, drawing-off by means of an endless screw. A combination, in series and/or in parallel, of several separation means of the same type or of different types can be used during this stage f) of separating the sediments and residues of catalysts. One of these solid-liquid separation techniques can require the periodic use of a light rinsing fraction, originating from the process or not, making it possible for example to clean a filter and remove the sediments.

The heavy liquid fraction originating from stage f) with a reduced sediment content can advantageously serve as fuel-oil base or as a fuel oil, in particular as a bunker oil base or as a bunker oil, having a sediment content after ageing of less than 0.1% by weight. Advantageously, said heavy liquid fraction is mixed with one or more fluxing bases selected from the group constituted by the light cycle oils of a catalytic cracking, the heavy cycle oils of a catalytic cracking, the residue of a catalytic cracking, a kerosene, a gas oil, a vacuum distillate and/or a decanted oil.

Fluxing

The liquid hydrocarbon-containing fractions can advantageously be used, at least partially, as fuel-oil bases or as fuel oil, in particular as a bunker oil base or as a bunker oil with a sediment content after ageing of less than or equal to 0.1% by weight.

By "fuel oil" is meant in this invention a hydrocarbon-containing fraction that can be used as fuel. By "fuel-oil base" is meant in this invention a hydrocarbon-containing fraction which, mixed with other bases, constitutes a fuel oil.

In order to obtain a fuel oil, the liquid hydrocarbon-containing fractions originating from stage f) can be mixed with one or more fluxing bases selected from the group constituted by the light cycle oils of a catalytic cracking, the heavy cycle oils of a catalytic cracking, the residue of a catalytic cracking, a kerosene, a gas oil, a vacuum distillate and/or a decanted oil. Kerosene, gas oil and/or vacuum distillate produced in the process of the invention will preferably be used.

DETAILED DESCRIPTION OF THE FIGURES

The following figures describe embodiment examples of the invention, without limiting its scope.

FIG. 1 shows a process according to the invention with separation of the effluent from the hydrotreatment zone with decompression. Introduction of the feedstock (10) up to discharge of the effluent (42) represents the hydrotreatment zone, and this zone is described briefly, as numerous variants known to a person skilled in the art are possible.

In FIG. 1, the feedstock (10), pre-heated in the vessel (12), mixed with recycled hydrogen (14) and make-up hydrogen (24) pre-heated in the vessel (16), is introduced via the pipeline (18) into the guard zone represented by the two reactors Ra and Rb. These reactors are generally switchable reactors, meaning that they operate according to a series of cycles, each comprising four successive stages:

- a first stage (stage i) during which the feedstock passes successively through the reactor Ra, and then the reactor Rb,
- a second stage (stage ii) during which the feedstock only passes through the reactor Rb, the reactor Ra being short-circuited for catalyst regeneration and/or replacement,
- a third stage (stage iii) during which the feedstock passes successively through reactor Rb, and then the reactor Ra,
- a fourth stage (stage iv) during which the feedstock only passes through the reactor Ra, the reactor Rb being short-circuited for catalyst regeneration and/or replacement. The cycle can then begin again.

The effluent leaving the guard reactor or reactors (Ra, Rb) is optionally mixed again with hydrogen arriving via the pipeline (65) into an HDM reactor (32) that contains a fixed catalyst bed. For clarity, a single HDM reactor (32) and a single HDS reactor (38) are shown in the figure, but the HDM and HDS section can comprise several HDM and HDS reactors in series.

The effluent from the HDM reactor is drawn off via pipeline (34), and is then sent to the first HDS reactor (38), where it passes through a fixed catalyst bed.

The effluent originating from the hydrotreatment stage can be sent via the line (42) to a high-pressure high-temperature (HPHT) separator (44), from which a gaseous fraction (46) and a liquid fraction (48) are recovered. The gaseous fraction (46) is sent, generally via an exchanger (not shown) or an air cooler (50) for cooling, to a high-pressure low-temperature (HPLT) separator (52), from which a gaseous fraction (54) containing the gases ($H_2$, $H_2S$, $NH_3$, C1-C4 hydrocarbons, etc.) and a liquid fraction (56) are recovered. The gaseous fraction (54) originating from the high-pressure low-temperature (HPLT) separator (52) can be treated in a hydrogen purification unit (58), from which hydrogen (60) is recovered, in order to recycle it via the compressor (62) and the line (65) to the reactors (32) and/or (38) or via the line (14) to the switchable reactors (Ra, Rb). The liquid fraction (56) originating from the high-pressure low-temperature (HPLT) separator (52) is expanded in the device (68) and then sent to the fractionation system (70). The liquid fraction (48) originating from the high-pressure high-temperature (HPHT) separator (44) is advantageously expanded in the device (72) and then sent to the fractionation system (70). The fractions (56) and (48) can be sent together, after expansion, to the fractionation (70).

The fractionation system (70) advantageously comprises an atmospheric distillation system for the production of a gaseous effluent (74), at least one so-called light fraction (76), in particular containing naphtha, kerosene and diesel, and an atmospheric residue fraction (78).

A part of the atmospheric residue fraction can be sent via the line (80) to the hydrocracking reactors (98, 102). All or a part of the atmospheric residue fraction (78) is sent to a vacuum distillation column (82) for recovering a fraction (84) containing the vacuum residue and a vacuum distillate fraction (86) containing vacuum gas oil.

The vacuum residue fraction (84), optionally mixed with a part of the atmospheric residue fraction (80) and/or with a part of the vacuum distillate fraction (86), is mixed with recycled hydrogen (88) optionally supplemented with make-up hydrogen (90) pre-heated in the furnace (91). It optionally passes through a furnace (92). Optionally, a co-feedstock (94) can be introduced.

The heavy fraction is then introduced via the line (96) into the hydrocracking stage at the base of the first ebullating-bed reactor (98) functioning with liquid and gas upflow and containing a hydrocracking catalyst of the supported type. Optionally, the converted effluent (104) originating from the reactor (98) can be subjected to separation of the light fraction (106) in an interstage separator (108).

All or a part of the effluent (110) originating from the interstage separator (108) is advantageously mixed with additional hydrogen (157), if required pre-heated beforehand (not shown). This mixture is then injected through the pipeline (112) into a second hydrocracking reactor (102) also using an ebullating bed functioning with liquid and gas upflow containing a hydrocracking catalyst of the supported type.

The operating conditions, in particular the temperature, in this reactor are selected so as to achieve the conversion level sought, as described previously.

The effluent from the hydrocracking reactors is sent, through the line (134), into a high-pressure high-temperature (HPHT) separator (136) from which a gaseous fraction (138) and a heavy liquid fraction (140) are recovered.

The gaseous fraction (138) is generally sent, via an exchanger (not shown) or an air cooler (142) for cooling, to a high-pressure low-temperature (HPLT) separator (144) from which a gaseous fraction (146) containing the gases ($H_2$, $H_2S$, $NH_3$, C1-C4 hydrocarbons, etc.) and a liquid fraction (148) are recovered.

The gaseous fraction (146) from the high-pressure low-temperature (HPLT) separator (144) is advantageously treated in the hydrogen purification unit (150) from which the hydrogen (152) is recovered for recycling, via the compressor (154) and the line (156) and/or the line (157), to the hydrocracking section.

The liquid fraction (148) from the high-pressure low-temperature (HPLT) separator (144) is expanded in the device (160) then sent to the fractionation system (172).

Optionally, a medium-pressure separator (not shown) after the expander (160) can be installed for recovering a vapour phase, which is sent to the purification unit (150) and/or to a dedicated medium-pressure purification unit (not shown), and a liquid phase, which is sent to the fractionation section (172).

The heavy liquid fraction (140) originating from the high-pressure high-temperature (HPHT) separator (136) is expanded in the device (174) then sent to the fractionation system (172). Optionally, a medium-pressure separator (not shown) after the expander (174) can be installed in order to recover a vapour phase, which is sent to the purification unit (150) and/or to a dedicated medium-pressure purification unit (not shown), and a liquid phase which is sent to the fractionation section (172).

The fractions (148) and (140) can be sent together, after expansion, to the system (172). The fractionation system (172) comprises an atmospheric distillation system for producing a gaseous effluent (176), at least one fraction known as light (178), containing in particular naphtha, kerosene and diesel, and an atmospheric residue fraction (180).

All or a part of the atmospheric residue fraction (180) can be sent to a vacuum distillation column (184) to recover a fraction containing the vacuum residue (186) and a vacuum distillate fraction (188) containing vacuum gas oil.

The atmospheric residue fraction (182) and/or the vacuum residue fraction (186) are subjected to a stage of maturation and separation of the sediments and residues of catalysts in order to constitute the fuel-oil bases sought.

A fraction (182) of the atmospheric residue type is optionally pre-heated in a furnace or an exchanger (205) so as to reach the temperature necessary for the maturation (conversion of the potential sediments into existing sediments) which takes place in the enclosure (207). The function of the enclosure (207) is to ensure a residence time necessary for the maturation, it can therefore be a horizontal or vertical drum, a buffer tank, a stirred tank or a piston reactor. The heating function can be incorporated in the enclosure in the case of a heated stirred tank according to an embodiment, not shown. The enclosure (207) can also make decantation possible so as to remove a part of the solids (208). The stream (209) originating from the maturation is then subjected to a solid-liquid separation (191) so as to obtain a fraction (212) with a reduced sediment content and a fraction (211) rich in sediments. In a similar way, a fraction (186) of the vacuum residue type is optionally pre-heated in a furnace or an exchanger (213) so as to reach the temperature necessary for the maturation which takes place in the enclosure (215). The function of the enclosure (215) is to ensure a residence time necessary for the maturation, it can therefore be a horizontal or vertical drum, a buffer tank, a stirred tank or a piston reactor. The heating function can be incorporated in the enclosure in the case of a heated stirred tank according to an embodiment, not shown. The enclosure (215) can also make decantation possible so as to remove a part of the solids (216). The stream (217) originating from the maturation is then subjected to a solid-liquid separation (192) so as to obtain a fraction (219) with a reduced sediment content and a fraction (218) rich in sediments.

According to an embodiment, not shown, the maturation devices (207) and (215) can operate in the presence of a gas, in particular an inert or oxidizing gas, or a mixture of inert gas and oxidizing gas. In the case where gas is used during the maturation, a device, not shown, will make it possible to separate the gas from the liquid.

According to an embodiment, not shown, it is also possible to carry out a stage of maturation and separation of the sediments and residues of catalysts on a fraction originating from the stage of separating the hydrocracking effluent, for example on a heavy cut originating from a separator, for example on the stream (140) before or after the expansion (174). An advantageous embodiment, not shown, can consist of carrying out the stage of maturation and separation of the sediments on the stream recovered at the bottom of a stripping column. When the stage of maturation and separation of the sediments and residues of catalysts is carried out upstream of a distillation column, this column is less susceptible to clogging.

At least a part of the streams (188) and/or (212) and/or (219) constitutes one or more of the fuel-oil bases sought, in particular of the bases for bunker oils with low sulphur content and a low sediment content. A part of the streams (188) and/or (212) and/or (219), before or after the stage of maturation and separation of the sediments, can be recycled, via the line (190), to the hydrocracking stage, or upstream of the hydrotreatment stage (line not shown).

Recycling of a cut of the vacuum gas oil type (188) upstream of the hydrotreatment can make it possible to lower the viscosity of the feedstock and thus facilitate pumping. Recycling of a cut of the atmospheric residue type (212) or vacuum residue type (219) upstream of hydrotreatment or hydrocracking can make it possible to increase the overall conversion.

Figure 2:
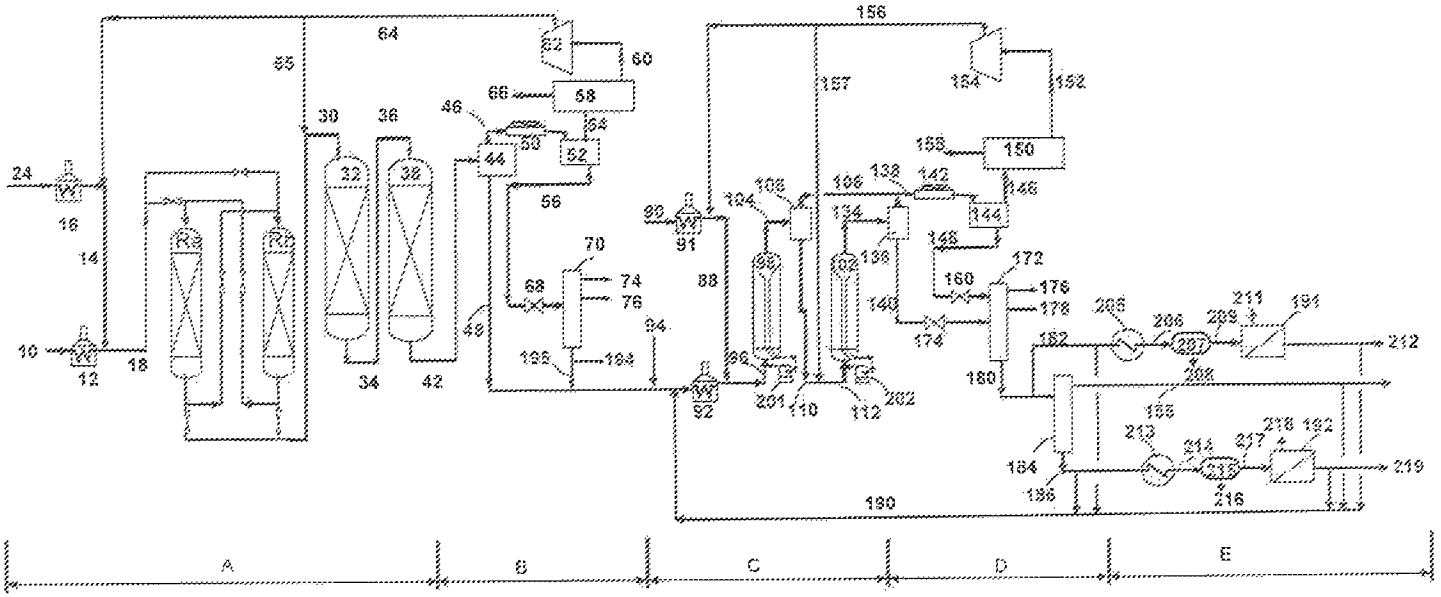
FIG. 2 shows a diagrammatic view of the process according to the invention in a variant in which the zone for the separation of the effluent from the hydrotreatment zone is simplified.

FIG. 2 shows another process according to the invention with separation of the effluent from the hydrotreatment zone without decompression. There will be described below essentially only the differences between the process according to FIG. 2 and the process according to FIG. 1, the stages of hydrotreatment, hydrocracking and separation after hydrocracking (and their reference symbols) moreover being strictly identical.

The effluent treated in the hydrotreatment reactors is sent via the line (42) to a high-pressure high-temperature (HPHT) separator (44), from which a lighter fraction (46) and a residual fraction (48) are recovered.

The residual fraction (48) is directly sent after optional passage through a furnace (92) to the hydrocracking section.

The lighter fraction (46) is sent, generally via an exchanger (not shown) or an air cooler (50) for cooling, to a high-pressure low-temperature (HPLT) separator (52), from which a gaseous fraction (54) containing the gases ($H_2$, $H_2S$, $NH_3$, C1-C4 hydrocarbons etc.) and a liquid fraction (56) are recovered.

The gaseous fraction (54) from the high-pressure low-temperature (HPLT) separator (52) is treated in the hydrogen purification unit (58), from which hydrogen (60) is recovered for recycling via the compressor (154) and the lines (64) and (156) to the hydrotreatment section and/or to the hydrocracking section.

The gases containing undesirable nitrogen-containing, sulphur-containing and oxygen-containing compounds are advantageously removed from the installation (stream (66)). In this configuration, a single compressor (154) is used for supplying all of the reactors that require hydrogen.

The liquid fraction (56) originating from the high-pressure low-temperature (HPLT) separator (52) is expanded in device (68) and then sent to the fractionation system (70).

The fractionation system (70) comprises an atmospheric distillation system for the production of a gaseous effluent (74), at least one so-called light fraction (76), in particular containing naphtha, kerosene and diesel and an atmospheric residue fraction (195).

A part of the atmospheric residue fraction can be sent, by means of a pump, not shown, via the line (195) to the hydrocracking reactors (98, 102), while another part of the atmospheric residue fraction (194) can be sent to another process (hydrocracking or FCC or hydrotreatment).

A variant which is not shown but which is similar to the diagram in FIG. 2 can consist of not using the fractionation system (70) nor expanding the liquid fraction (56) originating from the cold separator (52). The liquid fraction (56) is then sent to the hydrocracking section optionally by means of a pump, mixed with the heavy fraction (48) originating from the separator (44).

Figure 3:
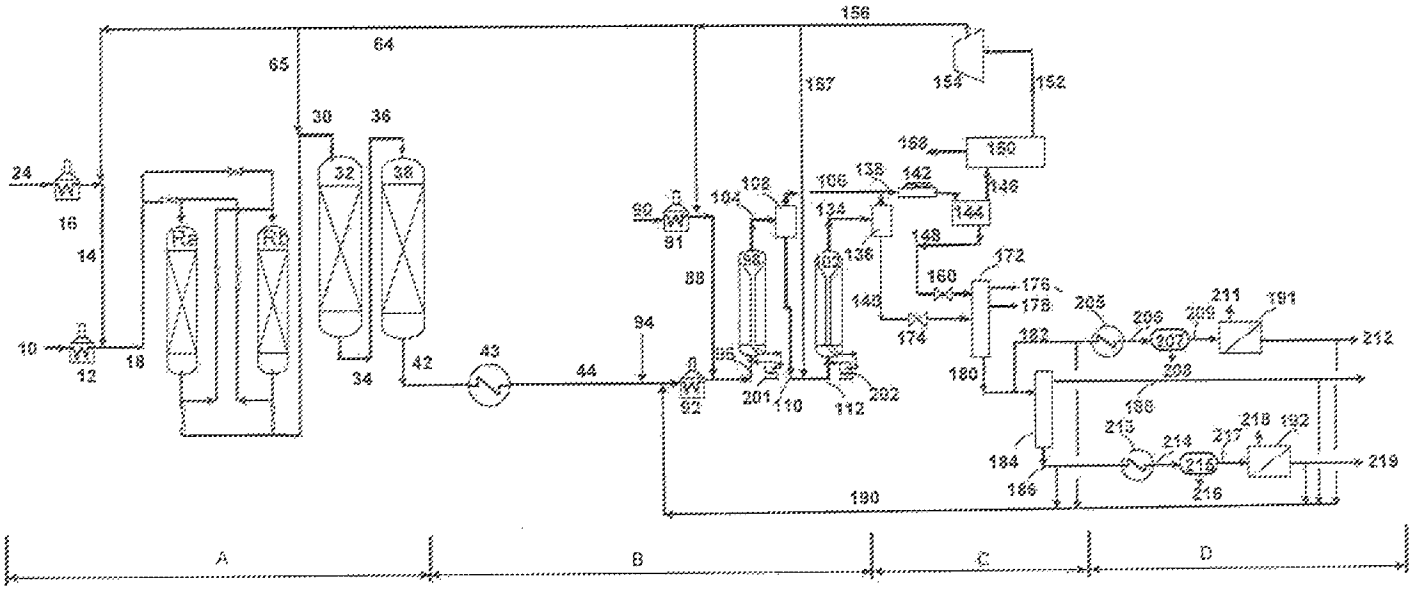
FIG. 3 shows a diagrammatic view of the process without a zone for the separation of the effluent from the hydrotreatment zone.

FIG. 3 shows another process according to the invention without the stage of separation of the hydrotreatment effluent. There will be described below essentially only the differences between the process according to FIG. 3 and the processes according to FIGS. 1 and 2, the stages of hydrotreatment, hydrocracking and separation after hydrocracking (and their reference symbols) moreover being strictly identical. In the embodiment without the stage of separation of the hydrotreatment effluent, the effluent (42) from the fixed-bed hydrotreatment reactor (38) is injected without separation and without decompression into the hydrocracking reactor (98), via optional thermal equipment (43), (92) allowing the inlet temperature of the hydrocracking reactor to be adjusted. During separation of the effluent from the hydrocracking section (134), a gas rich in hydrogen is recovered and recycled to the hydrotreatment section and the hydrocracking section.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding application No. FR 1460627, filed Nov. 4, 2014 are incorporated by reference herein.

EXAMPLES

Comparative Example and Example According to the Invention

The following example illustrates the invention but without limiting its scope. A vacuum residue (Ural VR) containing 87.0% by weight of compounds boiling at more than 520° C., having a density of 9.5° API and a sulphur content of 2.72% by weight, was treated.

The feedstock was subjected to a hydrotreatment stage including two switchable reactors. The operating conditions are given in Table 1.

TABLE 1

Operating conditions of the fixed-bed hydrotreatment stage

| HDM and HDS catalysts | NiMo on alumina |
|---|---|
| Temperature (° C.) | 370 |
| Partial pressure $H_2$ (MPa) | 15 |
| HSV (h−1, Sm3/h fresh feedstock/$m^3$ of fixed-bed catalyst) | 0.18 |
| $H_2$/HC inlet of fixed-bed section excluding $H_2$ consumption ($Nm^3/m^3$ of fresh feedstock) | 1000 |

The effluent from hydrotreatment is then subjected to a separation stage to recover a light fraction (gas) and a heavy fraction containing a majority of compounds boiling at more than 350° C. (350° C.+ fraction).

The heavy fraction (350° C.+ fraction) is then treated in a hydrocracking stage comprising two successive ebullating-bed reactors with two sets of temperature.

The operating conditions of the hydrocracking stage are given in Table 2.

TABLE 2

Operating conditions of the hydrocracking section

| Catalysts | 2 ebullating beds NiMo on alumina | 2 ebullating beds NiMo on alumina |
|---|---|---|
| Temperature R1 (° C.) | 418 | 423 |
| Temperature R2 (° C.) | 428 | 431 |
| Partial pressure $H_2$ (MPa) | 13.5 | 13.5 |
| HSV of "reactors" (h−1, Sm3/h fresh feedstock/$m^3$ of reactors) | 0.3 | 0.3 |
| HSV of "ebullating-bed catalysts" (h−1, Sm3/h fresh feedstock/$m^3$ of ebullating-bed catalysts) | 0.6 | 0.6 |
| Concentration of "slurry" catalyst (ppm of precursor in the feedstock at inlet of "slurry" beds) | — | — |

TABLE 2-continued

| Operating conditions of the hydrocracking section | | |
|---|---|---|
| Catalysts | 2 ebullating beds NiMo on alumina | 2 ebullating beds NiMo on alumina |
| $H_2$/HC inlet of hydrocracking section except $H_2$ consumption ($Nm^3/m^3$ of fresh feedstock) | 600 | 600 |

The effluents from the hydrocracking stage were then subjected to a separation stage making it possible to separate a gaseous fraction and a heavy liquid fraction by means of separators and atmospheric and vacuum distillation columns. Moreover, prior to the vacuum distillation stage, the heavy liquid fraction is subjected to a treatment according to 2 variants:

- a stage of separation of the sediments and residues of catalysts comprising a metallic porous filter of type Pall® (not according to the invention; according to the prior art)
- a stage of maturation carried out for 4 h at 150° C. and separation of the sediments and residues of catalysts comprising a filter (according to the invention)

The yields and the sulphur contents of each fraction obtained in the effluents leaving the overall chains are given in Table 3 below:

TABLE 3

| Yield and sulphur content of the effluent from the hydrocracking section (% by weight/feedstock) | | | | |
|---|---|---|---|---|
| | Fixed-bed hydrotreatment + separation + Hydrocracking 2 ebullating beds (418/428° C.) | | Fixed-bed hydrotreatment + separation + Hydrocracking 2 ebullating beds (423/431° C.) | |
| Products | Yield (% by weight) | S (% by weight) | Yield (% by weight) | S (% by weight) |
| $NH_3$ | 0.7 | 0 | 0.7 | 0 |
| $H_2S$ | 2.7 | 94.12 | 2.7 | 94.12 |
| C1-C4 (gas) | 3.8 | 0 | 4.0 | 0 |
| Naphtha (PI-150° C.) | 8.0 | 0.02 | 9.3 | 0.02 |
| Diesel (150° C.-350° C.) | 22.7 | 0.05 | 24.6 | 0.05 |
| Vacuum distillate (350° C.-520° C.) | 29.5 | 0.26 | 31.5 | 0.28 |
| Vacuum residue (520° C.+) | 34.3 | 0.43 | 29.3 | 0.47 |

The operating conditions of the hydrocracking stage coupled with the different variants of treatment (separation of the sediments with or without the maturation stage) of the heavy liquid fraction originating from the atmospheric distillation have an effect on the stability of the effluents obtained. This is illustrated by the contents of sediments after ageing measured in the atmospheric residues (350° C.+ cut) after the stage of separation of the sediments.

The performance of the three treatment schemes is summarized in Table 4 below:

TABLE 4

| Summary of performance | | | |
|---|---|---|---|
| | Fixed-bed hydrotreatment + separation + Hydrocracking 2 ebullating beds (418/428° C.) | Fixed-bed hydrotreatment + separation + Hydrocracking 2 ebullating beds (423/431° C.) | |
| $H_2$ consumption (% by weight/feedstock) | 1.7 | 1.8 | |
| Degree of hydrodesulphurization (%) | 91 | 91 | |
| Conversion (%) | 61 | 66 | |
| Maturation | No | No | Yes |
| Separation of the sediments | Yes | Yes | Yes |
| Sediment content after ageing (IP390) in the 350° C.+ cut originating from separation of the sediments | <0.1 | 0.4 | <0.1 |

The maturation stage prior to separation of the sediments makes it possible to form all of the potential sediments and thus allow their efficient separation. Without maturation, beyond a certain level of conversion which leads to a large amount of potential sediments being obtained, the stage of separation of the sediments is not sufficiently effective for the sediment content after ageing (IP390) to be less than 0.1% by weight, i.e. the maximum content required for bunker oils.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for treating a hydrocarbon-containing feedstock containing at least one hydrocarbon fraction having a sulphur content of at least 0.1% by weight, an initial boiling temperature of at least 340° C. and a final boiling temperature of at least 440° C. for obtaining a liquid hydrocarbon-containing fraction having a sediment content after ageing of less than or equal to 0.1% by weight, said process comprising:

a) treating said hydrocarbon-containing feedstock in a fixed-bed hydrotreatment stage, wherein said hydrocarbon-containing feedstock and hydrogen are brought into contact with a hydrotreatment catalyst to produce a hydrotreatment effluent, b) optionally separating said hydrotreatment effluent in a separation stage into at least one light hydrocarbon fraction containing a fuel base and a heavy fraction containing compounds boiling at at least 350° C., c) treating either at least a part of the hydrotreatment effluent originating from a) or at least a part of the heavy fraction originating from b), in a hydrocracking stage comprising at least one ebullating-bed reactor containing a supported ebullating-bed catalyst to produce a hydrocracked effluent, d) separating the hydrocracked effluent in another separation stage to obtain at least one gaseous fraction and at least one heavy liquid fraction, e) subjecting said heavy liquid fraction to maturation in a maturation stage during which a part of potential sediments are converted into existing sediments, wherein said maturation is carried out for a duration of between 60 and 1500 minutes, at a temperature between 50 and 350° C., at a pressure of less than 20 MPa, and in the presence of an inert gas and/or an oxidizing gas, f) separating existing sediments from said heavy liquid fraction originating from e) in a separation stage to obtain a liquid hydrocarbon-containing fraction having a sediment content after ageing of less than or equal to 0.1% by weight.

2. The Process according to claim 1, wherein said hydrotreatment comprises performing hydrodemetallization in one or more fixed-bed hydrodemetallization zones and subsequently performing hydrodesulphurization in one or more fixed-bed hydrodesulphurization zones.

3. The process according to claim 1, wherein said hydrotreatment is carried out at a temperature of between 300° C. and 500° C., a hydrogen partial pressure of between 5 MPa and 35 MPa, a space velocity of the hydrocarbon-containing feedstock within a range from 0.1 $h^{-1}$ to 5 $h^{-1}$, and a quantity of hydrogen mixed with the hydrocarbon-containing feedstock of between 100 $Nm^3/m^3$ and 5000 $Nm^3/m^3$.

4. The process according to claim 1, wherein said hydrocracking is carried out at an absolute pressure of between 5 MPa and 35 MPa, at a temperature of between 330° C. and 550° C., with a space velocity within a range from 0.1 $h^{-1}$ to 10 $h^{-1}$, and a quantity of hydrogen mixed with the feedstock of from 50 $Nm^3/m^3$ to 5000 $Nm^3/m^3$.

5. The process according to claim 1, wherein said separating of sediments from said heavy liquid fraction is carried out by means of at least one separation means selected from a filter, a separation membrane, a bed of filtering solids of the organic or inorganic type, an electrostatic precipitation, a centrifugation system, decantation, and drawing-off by means of an endless screw.

6. The process according to claim 1, wherein said a hydrocarbon-containing feedstock is selected from atmospheric residues, vacuum residues originating from direct distillation, crude oils, topped crude oils, deasphalted oils, deasphalting resins, asphalts or deasphalting pitches, residues originating from conversion processes, aromatic extracts originating from lubricant base production chains, bituminous sands or derivatives thereof, and oil shales or derivatives thereof, alone or in a mixture.

7. The process according to claim 1, wherein said liquid hydrocarbon-containing fraction is mixed with one or more fluxing bases selected from light cycle oils of a catalytic cracking, heavy cycle oils of a catalytic cracking, the residue of a catalytic cracking, a kerosene, a gas oil, a vacuum distillate and/or a decanted oil.

8. The process according to claim 3, wherein said hydrotreatment is carried out at a temperature of between 350° C. and 420° C. and at a hydrogen partial pressure of between 11 MPa and 20 MPa.

9. The process according to claim 3, wherein said hydrotreatment is carried out at a space velocity of said hydrocarbon-containing feedstock within a range from 0.1 $h^{-1}$ to 2 $h^{-1}$.

10. The process according to claim 3, wherein said hydrotreatment is carried out at a space velocity of said hydrocarbon-containing feedstock within a range from 0.1 $h^{-1}$ to 0.45 $h^{-1}$.

11. The process according to claim 3, wherein said quantity of hydrogen is between 200 $Nm^3/m^3$ and 2000 $Nm^3/m^3$.

12. The process according to claim 3, wherein said quantity of hydrogen is between 300 $Nm^3/m^3$ and 1500 $Nm^3/m^3$.

13. The process according to claim 4, wherein said hydrocracking is carried out at an absolute pressure of between 5 MPa and 25 MPa and a temperature of between 350° C. and 500° C.

14. The process according to claim 13, wherein said hydrocracking is carried out at an absolute pressure of between 6 MPa and 20 MPa.

15. The process according to claim 13, wherein said hydrocracking is carried out at an absolute pressure of between 11 MPa and 20 MPa.

16. The process according to claim 4, wherein said hydrocracking is carried out at a space velocity of 0.2 $h^{-1}$ to 5 $h^{-1}$.

17. The process according to claim 4, wherein said hydrocracking is carried out at a space velocity of 0.2 $h^{-1}$ to 1 $h^{-1}$.

18. The process according to claim 4, wherein the quantity of hydrogen mixed with the feedstock is 100 $Nm^3/m^3$ to 1500 $Nm^3/m^3$.

19. The process according to claim 4, wherein the quantity of hydrogen mixed with the feedstock is 200 $Nm^3/m^3$ to 1200 $Nm^3/m^3$.

20. The process according to claim 1, wherein said maturation is carried out for a duration of between 60 and 300 minutes.

21. The process according to claim 1, wherein said maturation is carried out for a duration of between 60 and 240 minutes.

22. The process according to claim 1, wherein said maturation is carried out at a temperature between 75 and 300° C. and at a pressure of less than 10 MPa.

23. The process according to claim 1, wherein said maturation is carried out at a temperature between 100 and 250° C. and at a pressure of less than 3 MPa.

* * * * *